US005250803A

United States Patent [19]

Christ et al.

[11] Patent Number: 5,250,803

[45] Date of Patent: Oct. 5, 1993

[54] SYSTEM FOR SETTING A DOCUMENT FEEDING APPARATUS FOR PROPER OPERATION

[75] Inventors: Bernhard J. Christ, Yonkers, N.Y.; Edward M. Ifkovits, Jr., New Fairfield; Philip G. Ruess, Norwalk, both of Conn.

[73] Assignee: Pitney Bowes Inc., Stamford, Conn.

[21] Appl. No.: 903,592

[22] Filed: Jun. 24, 1992

[51] Int. Cl.[5] ..... G01N 9/04

[52] U.S. Cl. ..... 250/223 R; 271/263

[58] Field of Search ..... 250/214 R, 223 R, 561, 250/571, 557; 271/262, 263, 258; 356/434

[56] References Cited

U.S. PATENT DOCUMENTS

| | | | |
|---|---|---|---|
| 3,542,479 | 11/1970 | Sibelis | 352/202 |
| 4,151,410 | 4/1979 | McMillian et al. | 250/223 |
| 4,237,378 | 12/1980 | Jones | 250/223 |
| 4,384,194 | 5/1983 | Jones | 377/8 |
| 4,600,185 | 7/1986 | Moll | 270/58 |
| 4,608,704 | 8/1986 | Sherman et al. | 377/8 |
| 4,671,502 | 6/1987 | Sherman et al. | 271/4 |
| 4,707,599 | 11/1987 | Sherman et al. | 250/223 |
| 4,738,627 | 11/1987 | Hughes et al. | 250/223 |
| 4,922,110 | 5/1990 | Melcher | 250/223 R |
| 5,084,628 | 1/1992 | Burge et al. | 250/571 |

*Primary Examiner*—David C. Nelms

*Attorney, Agent, or Firm*—Charles R. Malandra, Jr.; Melvin J. Scolnick

[57] ABSTRACT

A system for determining the proper operation of a feeding apparatus includes a detector for detecting the feeding of two or more overlapped documents. The detector is connected to a processor for processing detected information and providing an output signal indicating that the detector has detected the presence of two or more overlapped documents. An adjustment arrangement is connected to the detector for adjusting the detector to detect the presence of overlapped documents for various different types of documents to be utilized with the feeding apparatus. A display is connected to the detector which displays a first condition when no documents are detected by the detector, a second condition when a single document is detected by the detector and a third condition when overlapped documents are detected by the detector. The system may include two or more spaced apart detectors each with their own adjustment arrangement and associated display.

14 Claims, 8 Drawing Sheets

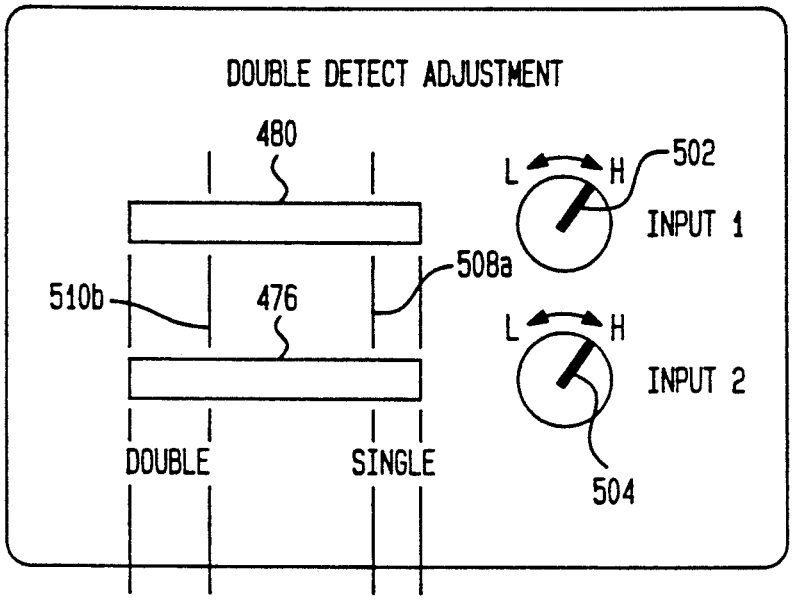
FIG. 5
FIG. 5A
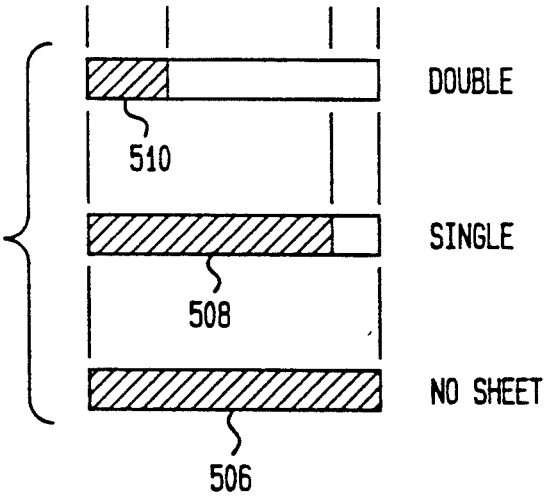

SYSTEM FOR SETTING A DOCUMENT FEEDING APPARATUS FOR PROPER OPERATION

FIELD OF THE INVENTION

The present invention relates to sheet or document feeding apparatus and, more particularly, to a system for setting such system to properly detect the presence of two or more overlapping sheets or documents being feed by the feeding apparatus.

BACKGROUND OF THE INVENTION

Various document feeders have been developed for feeding an accumulation of sheets or other documents. Typically, sheets of paper or any other documents such as checks or paper currency (hereinafter referred to as documents) are placed into a stack for feeding by the apparatus one at a time from the stack. The feeder separates the documents and feeds them at spaced intervals in single fashion, one at a time. The feeder can be a separate piece of equipment or part of a larger system such as an inserter system or a document folding system.

Various systems have been developed for determining the proper operation of the above noted type of feeders as well as for determining the proper operation of feeding equipment to detect the presence of two or more overlapping documents in the systems. This is often termed "double" detection.

The detection of doubles by a doubles detection system is required under various conditions and often for high speed feeding apparatus. In high speed feeding apparatus particularly, an improper feeding of two or more overlapped sheets or other documents can cause a jam in the system which can involve a large number of documents due to the speed of the system. Moreover, an improper feeding involving the overlapping of two or more documents, as for example in an inserter system, can result in improper collations of documents being assembled and thereafter inserted into the wrong envelope.

The detection of doubles is complicated in feeding equipment that is adapted to handle a wide variety of documents. This is because the documents can vary greatly in the thickness of the material, the print content, the graphics content thereon, as well as the color(s) of the documents as well as the color(s) of the printed content and graphics on such documents. Consider, the potential difficulty of detecting doubles, for example, for a two colored document with multicolored printing and graphics thereon and with a dark stripe along one side thereof. Moreover, the detection of doubles is further complicated by the presence of paper dust and other contaminants in sheet feeding equipment which can hinder proper operation of a doubles detection system.

SUMMARY OF THE INVENTION

It is an object of the present invention to provide a system for setting a feeding apparatus for proper operation so that it will reliably detect the presence of two or more documents being fed.

A further object of the present invention is to provide a system for setting a feeding apparatus for proper operation to detect the presence of doubles where the system can operate over a wide range of different types of documents having thereon a wide variety of printed material or graphics and over a wide variety of color(s) for both the documents and for the inks for the printing and graphics.

It is a further object of the present invention to provide a double detect system where an operator or user can easily and quickly set up the equipment for proper operation.

In accordance with the present invention a system for determining the proper operation of a feeding apparatus that feeds documents includes means for detecting the feeding of two or more overlapping documents. Adjustment means are connected to the detecting means for adjusting the detecting means to detect the presence of overlapping documents for various types of documents to be utilized with the feeding apparatus. The adjustment means includes display means operative to display a first condition when no documents are detected by the detecting means, a second condition when a single document is detected by the detecting means and a third condition when overlapped documents are detected by the detecting means.

BRIEF DESCRIPTION OF THE DRAWINGS

A complete understanding of the present invention may be obtained from the following detailed description of the preferred embodiment thereof, when taken in conjunction with the accompanying drawings, wherein like reference numerals designate similar elements in the various figures, and in which:

FIG. 5 is a front view of a user accessible double detect adjustment arrangement for the system shown in FIGS. 4 and 4A;

FIG. 5A is a diagramatic representation of the conditions obtaining in the two displays shown in FIG. 5 for various conditions in the adjustment process for the system shown in FIGS. 4 and 4A;

DETAILED DESCRIPTION OF THE PREFERRED EMBODIMENT

Figure 1:
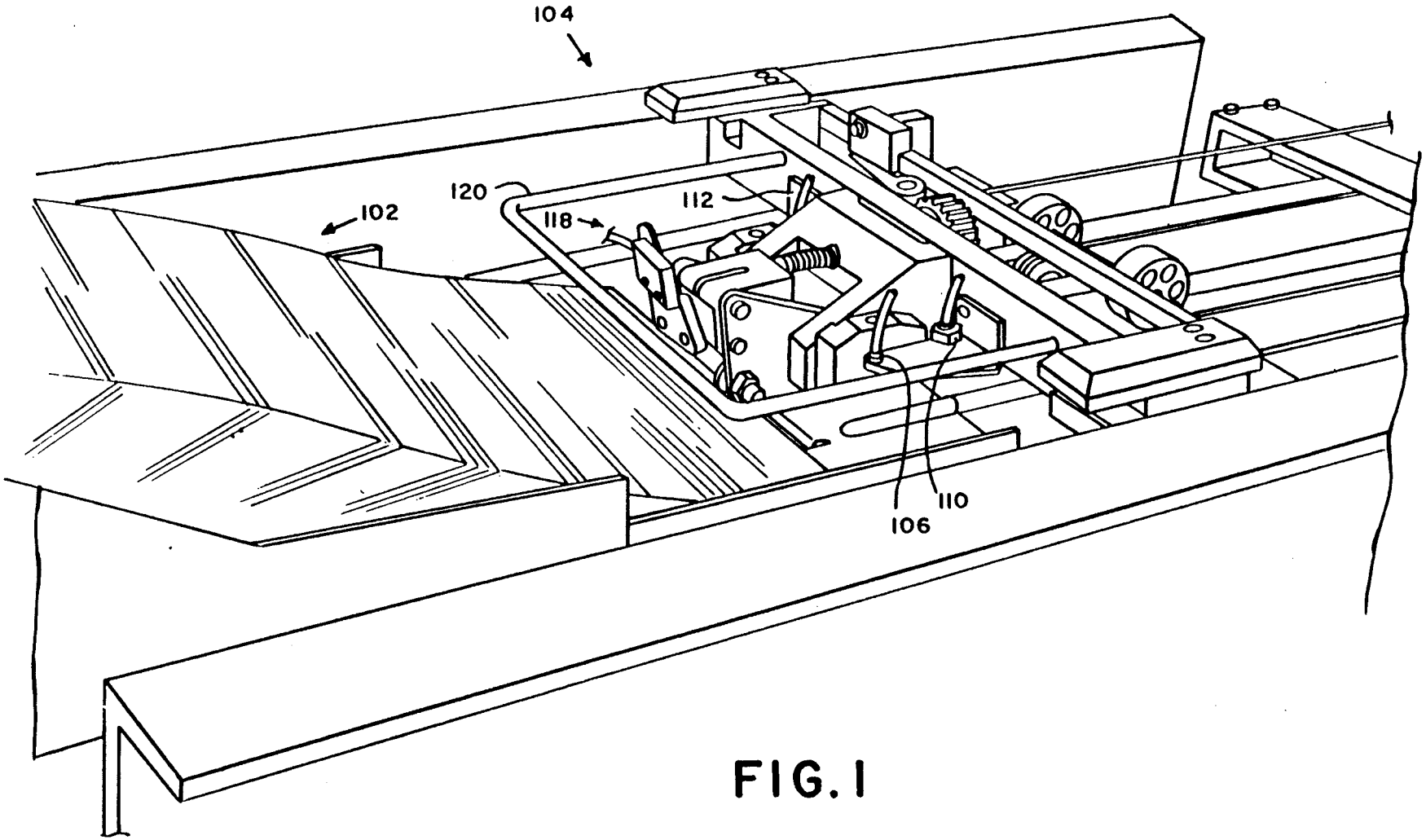
FIG. 1 is a perspective view of a document feeding apparatus embodying the present invention.
Figure 2:
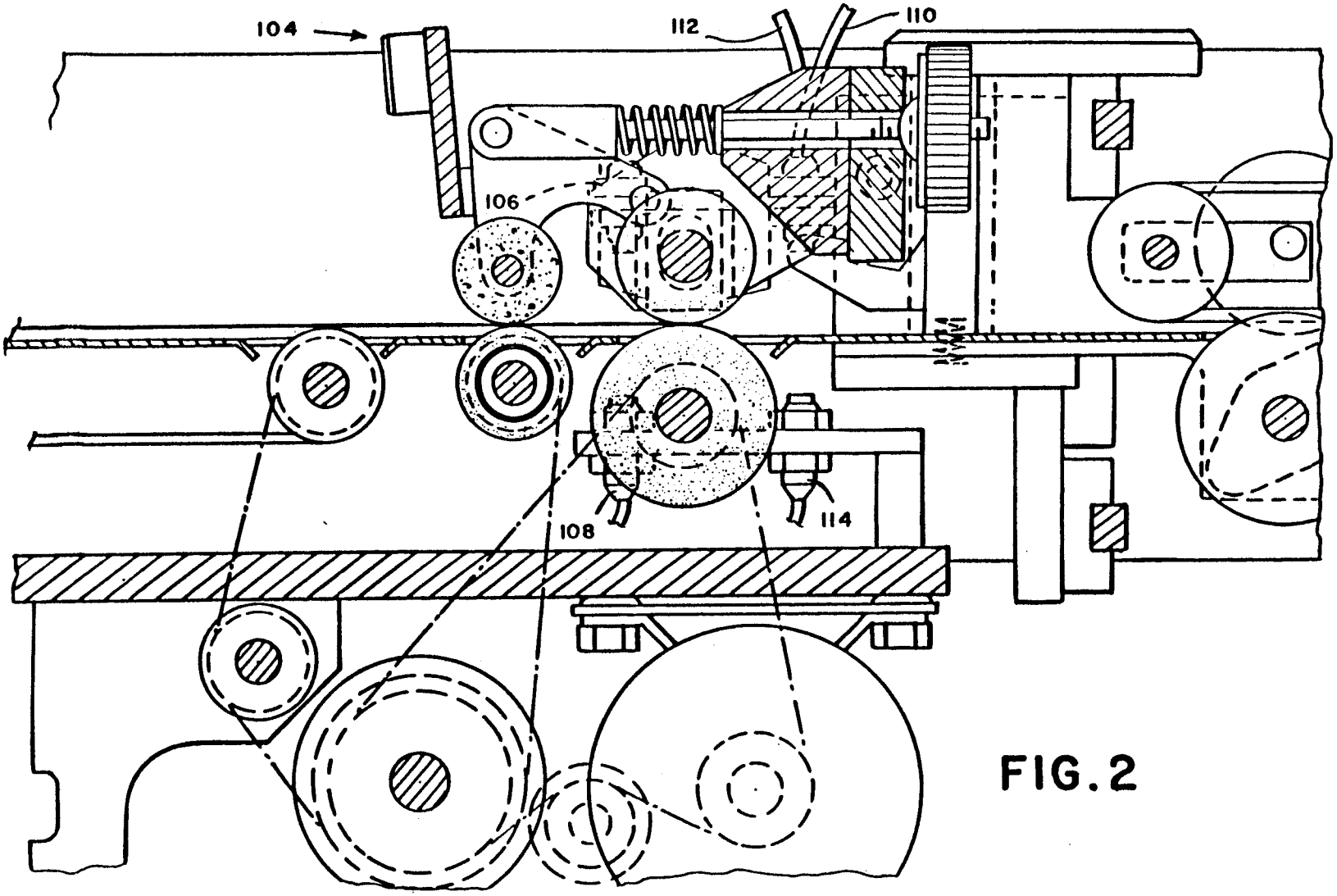
FIG. 2 is an enlarged partial section view of the document feeding apparatus shown in FIG. 1 to illustrate portions of the apparatus including the position and location of the light emitting diode (LED) and photo transistor assemblies utilized in detecting the lead edge of the sheets and overlapped, doubles, document conditions.
Figure 3:
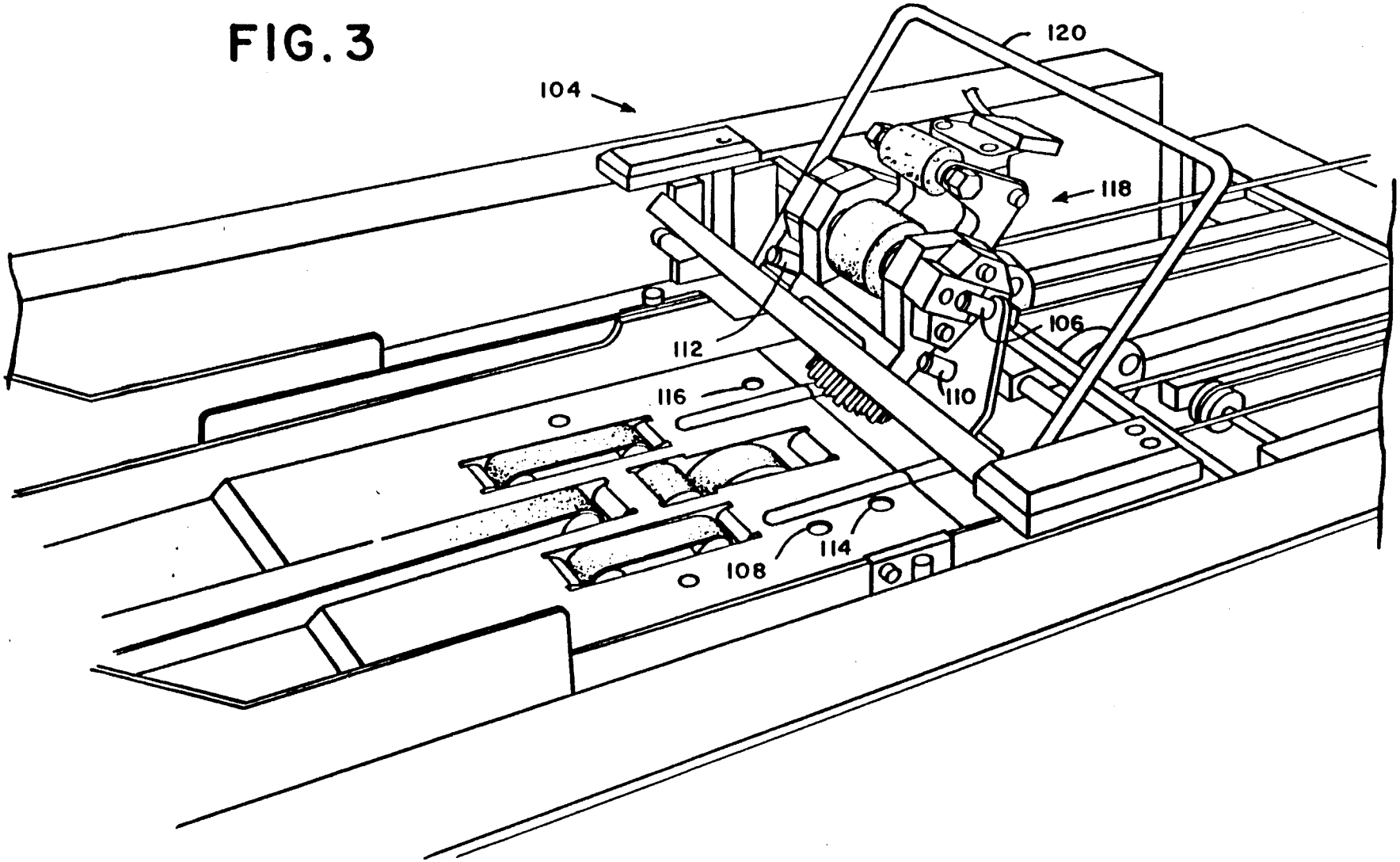
FIG. 3 is a perspective view of the document feeding apparatus shown in FIG. 1 with a swing bridge assembly rotated to an open position, further illustrating portions of the invention including the mounting of the photo transistor portions of the lead edge and double detecting system.

Reference is now made to FIGS. 1, 2 and 3 which show the construction of the document feeding apparatus. Portions of this apparatus are described in detail in pending U.S. Pat. application of Edward M. Ifkovits, Jr., Ser. No. 07/824,969 for PIVOTING SEPARATOR STONE FOR SINGULATING FEEDER, filed Jan. 24, 1992, and assigned to Pitney Bowes Inc.; and, in pending U.S. Pat. application of Edward M. Ifkovits, Jr., and Edward F. Ifkovits, Sr., Ser. No. 07/826,329 for ANTI-SKEW DEVICE FOR SINGULATING FEEDER, filed Jan. 24, 1992, and assigned to Pitney Bowes Inc. The disclosures of both these patent applications are hereby incorporated by reference. An accumulation of documents 102 are loaded into a document feeder shown generally at 104. The document feeder provides for the feeding of a single document from the accumulation of documents 102 to other portions of the equipment.

The document feeder includes a document lead and trail edge detecting system. This detecting system has a light emitting diode (LED) and photo transistor set operatively connected and positioned above and below the feed deck for the accumulation of documents 102. The LED portion of the detecting system is connected as part of the fixture 108 and the photo transistor is connected as part of the structure 106. The double document feed detect portion of the apparatus includes two separate double detect LED and photo transistors. The LEDs are positioned at fixture 114 and 116 to cooperate with photo transistor fixtures mounted at 110 and 112. The photo transistor fixtures 110 and 112 are mounted as part of a swing bridge shown generally at 118 which is operated by means of a handle 120 to rotate between an open position (FIG. 3) and a closed position (FIGS. 1 and 2). Thus, light from the various LEDs projects up from below the document feed path for the documents fed from the accumulation of documents 104 to impinge on the photo transistors mounted above the document feed path in the swing bridge 118.

A detailed description of the feed 104 mechanism is set forth in the above-identified two patent applications. The feeder 104 (as is the case with other feeding mechanisms) may under certain conditions feed two or more documents. The double detect system detects any "doubles" which may be fed by feeder 104 for a wide range of different types of documents with a wide range of different printing or graphics thereon.

Figure 4:
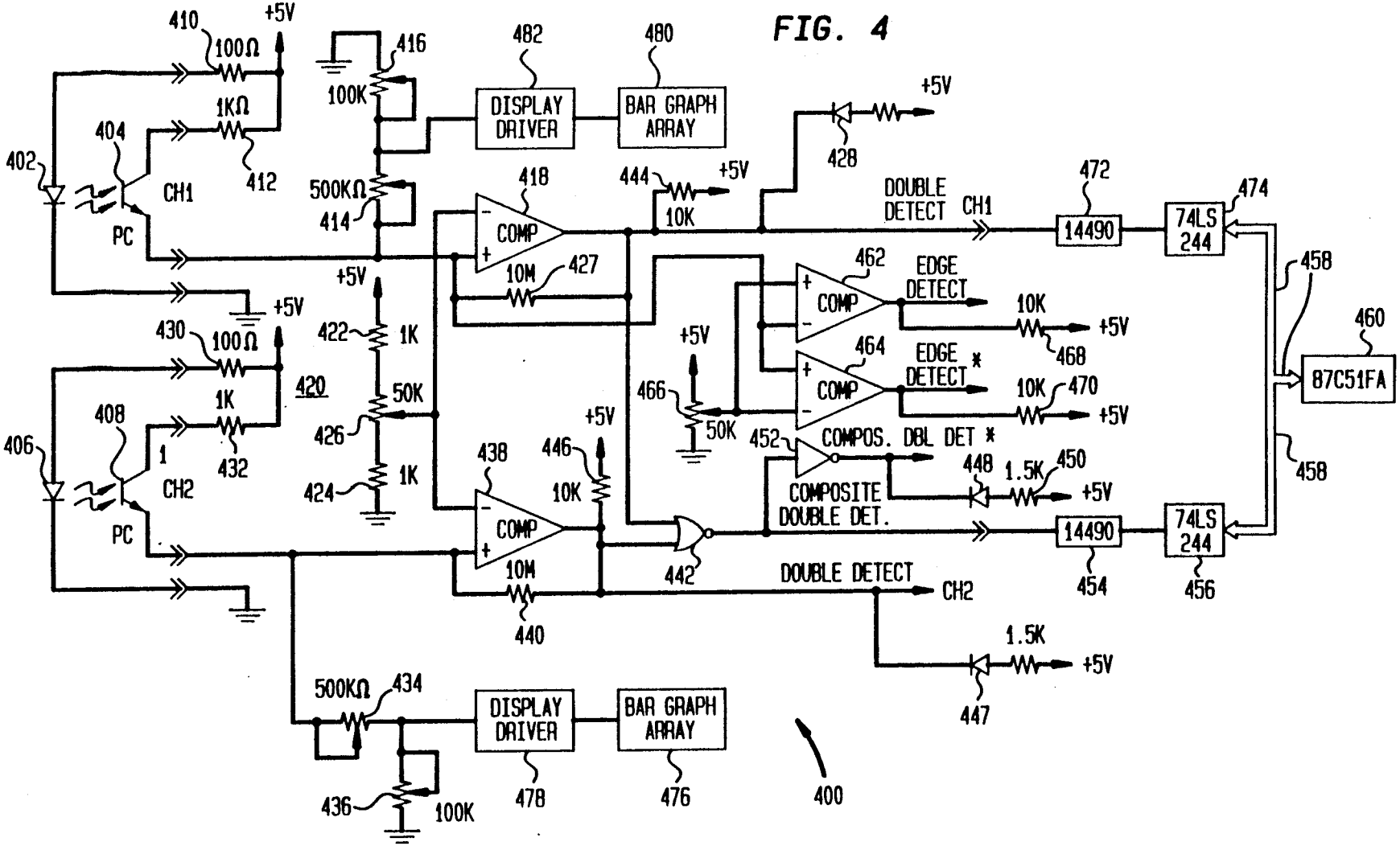
FIG. 4 is a schematic diagram, partially in block form, of a system for determining the proper operation of a document feeding apparatus and adapted to be utilized in conjunction with the apparatus shown in FIG. 1; and, FIG. 4A is a schematic diagram, partially in block form, of a system for determining the proper operation of a document feeding apparatus and suitable to be used with the apparatus shown in FIGS. 1–3 with an alternative edge detection arrangement.

Reference is now made to FIG. 4. The documents which are fed by the feeder 104 pass between the respective LED 402 and photo transistor 404 and LED 406 and photo transistor 408. The LED 402 and its associated photo transistor 404 are part of a first channel of information (CH1) regarding the state of the sheet feeding mechanism. Likewise, LED 406 and its associated photo transistor 408 are part of a second channel of information (CH2). Each detector channel provides information as to the presence in the feed path of: no documents; a single document; or, multiple documents. This provides information as to the proper operation of the feeder 104.

As previously noted in connection with FIGS. 1-3, the LEDs and their associated photo transistors sets are physically separated from one and other. This is to provide different information and thereby enable averaging or other processing of this information. This separation can be in a horizontal plane with lateral separation as is shown in FIG. 1-3 or vertical separation, not shown with separation along the direction of travel of the documents. Both forms of separation can also be beneficially simultaneously employed. This separation provides the ability to detect information in different areas of the document feed path of feeder 104. Additionally, the LED photo transistor sets can be set in different planes to add additional differentiation between the LED photo transistor sets.

The separation of the LED photo transistors sets provides the ability to obtain information from different portions of single or multiple sheets which might be under the LED photo transistor sets. The various forms of separation enable the system to compensate for different types of documents and printing or graphics on particular documents being fed by feeder 104. For example, any portion of a document may have printed thereon lines, bars or very dark surfaces, that could create resolution problems for the doubles detection. Such printing or graphics could if not properly compensated for, cause a false "double" detect. The present system provides a quick, easy and reliable compensation for each LED photo transistor set through various adjustments described in detail hereinafter. This compensation adjusts for different document thickness, document colors, ink colors and the like, all of which, along with other factors such as paper dust, create variations between individual documents and also between batches of documents which are fed through the feeder 104.

More than two channels of information can be provided by including additional LED photo transistor sets. The number of channels employed in any system depend on the variations in types of material to be handled by the system, the degree of accuracy required in detecting doubles and the cost to manufacture the double detector system. For certain applications such as feeding of paper currency from automatic bank teller machines, more channels of information may be desired, possibly with different forms of separation. Moreover, LED fixture 108 and photo transistor fixture 106 are not used as part of the circuit shown in FIGS. 4 and 4A. These fixtures 108 and 106 are to illustrate that additional channels, or as previously noted, separate lead document edge detection can be employed with the present system.

LED 402 is biased into conduction from a +5 volt source through resistor 410. The collector of transistor 404 is likewise coupled to the +5 volt source through a resistor 412. The emitter of transistor 404 is coupled to ground through a coarse adjustment potentiometer 414 and a fine adjustment potentiometer 416 which is operator or user accessible and will be described in greater detail hereinafter.

The transistor 404 is normally biased for conduction with no paper present between LED 402 and photo transistor 404. The emitter of the transistor 404 is directly connected to the positive input of comparator 418. The negative input of comparator 418 which establishes the threshold level for an output from comparator 418 is connected to an adjustable voltage divider network 420. The network 420 is connected between the +5 volt source and ground. The voltage divider network 420 is comprised of a first and second fixed resistor 422 and 424 and a variable potentiometer of 426 for adjustment purposes. A resistor 427 is connected between the positive input of comparator 418 and the comparator output to provide hysterisis and to prevent very quick changes in the output of comparator 418 to thereby provide noise immunity. The output of comparator 418 is connected to a LED 428 which is used as part of the system adjustment and function which will be described hereinafter.

Referring to Channel 2, LED 406 is biased into conduction from a +5 volt source through a resistor 430. The collector of the photo transistor 408 is coupled via a resistor 432 to the +5 volt source. The emitter of the photo transistor 408 is connected to ground through a coarse adjustment potentiometer 434 and a fine adjustment potentiometer 436 which is operator or user accessible and will be described in greater detail hereinafter.

The emitter of the photo transistor 408 is also connected to the positive input of a comparator 438. The negative input of comparator 438 is connected to the potentiometer arrangement 420 previously described. A resistor 440 is connected between the positive input terminal of the comparator 438 and its output terminal to provide noise immunity similar to that provided for comparator 418.

When Channel 1 and Channel 2 of the system do not detect the presence of a multiple number of documents (double detect of two or more documents), the voltages being provided to the positive inputs of comparators 418 and 438 are at a high enough voltage level such that they exceed the threshold set into the negative terminal of the comparators 418 and 438. Accordingly, the output from each of the comparators 418 and 438 Will be a logic high voltage. As a result, the voltage applied to the input terminals of a NOR gate 442 via the +5 volt supply through the respective resistors 444 and 446, results in the output of the NOR gate 442 providing a logic low output voltage 442.

It should be recognized that if the output from either the comparators 418 or 438 is high, the output from the NOR gate 442 will be low. This provides a composite double detection output based on the information being provided from the Channel 1 and Channel 2 detectors. For the output of NOR gate 442 to go high, both Channel 1 and Channel 2 detector systems must both simultaneously detect the presence of two or more documents between LED 406 and its respective photo transistor 408 and between LED 402 and its respective photo transistor 404.

When a single sheet of paper or other material is between LED 402 and photo transistor 404, the photo transistor 404 remains biased into conduction. The voltage applied to the positive input of comparator 418 is still sufficiently high compared to the reference voltage applied to the negative input terminal of comparator 418 such that the output from comparator 418 remains high. However, when two or more sheets of paper or other material are between the LED 402 and the photo detector transistor 404, the conduction of the photo transistor 404 decreases. This decrease in conduction is such that the voltage applied to the positive input terminal of comparator 418 is sufficiently below the reference voltage applied to the negative input of comparator terminal 418 so that the output from comparator 418 goes low. When a "double" is detected in Channel 1 and the output of comparator 418 goes low, a LED 428 is biased into conduction such that the LED emits light. Channel 2 of the system operates in precisely the same way. When comparator 438 output goes low LED 447 is biased into conduction such that the LED emits light.

An LED 448 is biased into conduction when NOR gate 442 provides a high output indicating a double condition exists at both Channel 1 and Channel 2. This is accomplished by connecting the LED 448 and its associated resistor 450 to ground through an inverter 452.

The output from the NOR gate 442, which when high provides an indication of a composite double detect by both Channel 1 and Channel 2, is coupled to a debounce circuit 454. The debounce circuit functions to remove noise from the output signal from the NOR gate 442 and provides noise immunity. The output signal from the debounce circuit 454 is coupled to a buffer circuit 456 to allow the signal to be put on to a data bus 458 connected to a microcomputer 460. The microcomputer 460 is connected and programmed to provide, as determined by any particular application, averaging over a portion or all of the length of a document or multiple documents being fed by feeder 104 and being detected by Channel 1 and Channel 2 LED photo transistor sets. This provides additional averaging to prevent false detection of doubles. Thus, averaging is accomplished both by the lateral or horizontal or other physical separation of the two LED - photo transistor sets and also by the the length of the sheet or other material which is scanned (or the time during which scanning of doubles occurs).

To enable the averaging over the length of a document portion thereof, the lead edge of the document is detected and the composite signal from NOR gate 442 is processed. The composite signal is fed into a software timer. The timer represents the distance traveled by the document (or multiple documents) through the feeder 104. When this composite signal is present, the timer is caused to run. When the composite signal is not present, the timer is stopped. Over the length of the document to insure a true "double" situation has been detected, the timer must overflow. This corresponds to the distance of movement of the document being fed and for which distance a double has been detected by both LED photo transistor sets. Typically, the timer is set to correspond to about ½ inch to 1 inch of travel of a document for which a double must be detected. This helps prevent false double detection due to printing or different information on the document.

The length of travel of the sheet of the document during which sampling occurs to determine if a double condition is present is a matter of design choice. The present system for the feeder shown in FIGS. 1-3. Where the detectors are physically separated 4.75 inches, samples the entire document from the leading edge of a document being fed by feeder 104 for approximately one-half inch.

An edge detection circuits including comparators 462 and 464 are provided to give an edge indication. This provides information as to the presence of a document (or multiple documents) or absence thereof. If the LED and associated photo transistor of Channel 1 and Channel 2 are offset in a vertical direction (along the direction of travel of a document), a determination would have to be made as to which LED photo transistor set is utilized as the edge detector. In most applications, the LED photo transistor set closest to the accumulation of documents 102 would be the lead edge detector. However, various applications could warrant that the other upstream LED photo transistor sets provide the lead edge of detection. For example if documents accumulate to close to the first photocell then the second photocell should be used as the lead edge photocell.

For the system shown in FIGS. 1-3, the emitter of photo transistor 404 is used for lead edge detection and is connected to comparator 462 and 464. Specifically, the emitter of transistor 404 is connected to the negative input terminal of comparator 462 and to the positive input terminal of comparator 464. The positive input terminal of comparator 462 and the negative terminal of comparator 464 are connected to a potentiometer 466 to allow for adjustment of the reference voltage for these comparators.

The two comparators 462 and 464 provide two opposite polarity output signals each of which indicate edge detection. The output terminal of each of the comparators is connected to the +5 volt source through respective resistors 468 and 470. For the arrangement shown, the comparator 462 output is a logic high output voltage when a document is detected by the LED 402 and the photo detector transistor 404. The detection of the lead edge of a document reduces the conduction of transistor 404. The conduction is reduced to a level such that the voltage applied to the negative input terminal of the comparator 462 drops sufficiently below the reference voltage applied to the positive input terminal so that the output from comparator 462 goes high. Because of the reversed polarity of the voltages applied to the positive and negative input terminals of comparator 464 from those of comparator 462, comparator 464 output is the inverse of the comparator 462 output. These comparator output signals for the arrangement shown in FIG. 4 are not used. The lead edge detect signal is obtained from comparator 418 (Channel 1) as previously noted. This signal is utilized to initiate various upstream functions including those associated with the start of a double detect cycle by Channel 1 and Channel 2.

Adjustment is provided in the double detect system for both a service technician utilizing the LEDs 428, 447 and 448 and by an operator or user of feeder 104 by means of the potentiometers 436 and 416 along With the information provided on respective bar graph array 476 with its associated display driver 478 and bar graph array 480 with its associated display driver 482. The display driver and bar graph array are commercially available devices such as National Semi-Conductor Display Driver LM3914 and Hewlett-Packard Bar Graph Array HDSP-4832. The specific bar graph array and display driver are not critical to this present invention and can be any suitable device as can any of the other components described hereinabove.

In the set up of the double detect system, a service technician will ensure that the LED and photo transistors sets 402, 404, 406, and 408 are correctly physically aligned in the equipment itself for proper operation. For each channel separately, the service technician grounds the positive input terminal of the comparator 418 and 438. With a single document between LED 402 and photo transistor 404, and, thereafter, separately between LED 406 and 408, the LED and photo transistors physically aligned to get the lowest possible voltage at the collector electrode of the respective photo transistors 404 and 408, as the case may be. This provides a proper alignment of the photo transistor and its respective LED. When this adjustment is completed, the grounding of the inputs to comparators 418 and 438 is removed.

The potentiometer arrangement 420 is then adjusted to provide the proper reference voltage on comparator 418 and 438 negative input terminals. For the present arrangement, a suitable reference voltage is approximately +2 volts. The fine adjustment for each Channel (by virtue of the potentiometers 416 and 436) are then adjusted to the middle of their range and a single document is placed between each of the LED and photo transistor sets for Channel 1 and Channel 2. With this condition obtaining, potentiometers 414 and 434 are separately adjusted so that the voltage at the positive input terminal of comparator 418 and the positive input terminal of comparator 438 are adjusted to approximately +2.75 volts.

With two documents placed between LED 406 and photo transistor 408 and, similarly between LED 402 and photo transistor 404, a verification is made that the voltage at the positive input terminals of comparators 418 and 438 has fallen approximately +1½ volts. If this has not occurred, each of the potentiometers 414 and 434 are readjusted to get the positive inputs to each comparator 418 and 438 within that range. LED 428 is used in the double detect adjustment of Channel 1 while LED 447 is used in the double detect adjustment of Channel 2. As these channels are adjusted, when a double is present in Channel 1, LED 428 will illuminate. Similarly, when a double is present in Channel 2, LED 447 will illuminate. Thus with two documents placed between the LED photo transistor sets of Channel 1 and Channel 2, the doubles detect LED 428 and 447 as well as the composite doubles detect LED 448, should all be illuminated. These three LEDs 428, 447 and 448 are used by the service technician to quickly and easily adjust the voltages to insure proper operation of the double detect system. The set up can be with specific types of documents to set the system to a condition that will allow it to be further adjusted by a user to cover a range of different types of documents of interest to that particular user.

The edge detect potentiometer 466 is adjusted by the service technicians such that the reference voltage applied to the negative terminal of comparator 464 and the positive terminal of comparator 462 are at approximately +3.5 volts.

In the operation, the double detect circuitry 400 is continuously activated while the feeder 104 is energized to operate. The activation of circuitry 400 occurs whether or not documents are actually being fed by feeder 104.

The system allows the capability to average information from the two channels and employ sample detection over a portion or an entire document being moved under the LED photo transistor sets 402–404 and 406–408. This provides great flexibility in the double detect system being able to handle a wide variety of document materials, printing and graphics. The present system can handle sheets of paper traveling at rates in excess of 200 inches per second with document material variations of 4 degrees thickness and variation of 6 to 9 thousands of an inch. Thus, the system is suitable for use with various ranges of feeding equipment such as heavy duty folder feeders, burster folders, inserters, collators, and all other forms of document feeding equipment where detection of feeding of overlapped documents is required.

Figure 4A:
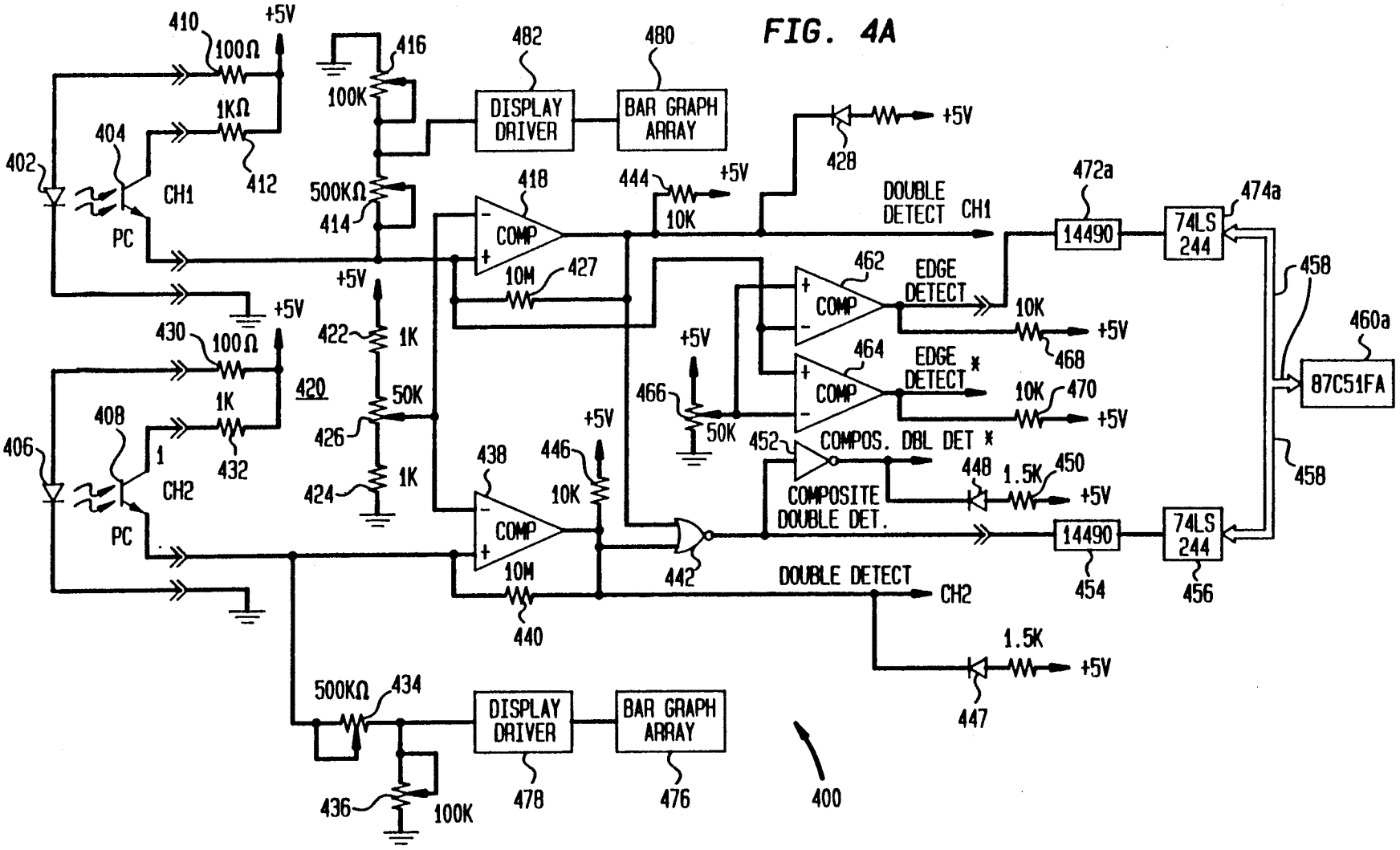

Reference is now made to FIG. 4A which system operates in the same manner as is shown and described in connection with FIG. 4; however, the edge detection system utilizes the flexibility of the system and is accomplished differently. Edge detection is achieved by utilizing the output signal from comparator 462. The output terminal of comparator 462 is connected through the debounce circuit 472A to provide noise immunity from the output signal from comparator 462 and is thereafter applied to the buffer circuit 474A so that the signal can be applied over the data bus 458 to the microcomputer 460A. As is the case with FIG. 4, the lead edge detect signal is utilized to initiate various upstream functions including those associated with the start of a double detect cycle Channel 2. For other systems, depending upon the design, the inverted output signal from comparator 464 can be employed for edge detection.

In both the systems shown in FIGS. 4 and 4A, numerous unused output signals are provided such as double detect Channel 2, composite inverted double detect, inverted edge detect; and, depending on the particular system, FIG. 4 or FIG. 4A, edge detect and double detect Channel 1. This design is to enable direct utilization of the double detect system in conjunction with various different processor arrangements available in existing equipment or to be designed into new equipment. To the extent that cost of the system becomes a factor various portions of the circuitry associated with non used signal outputs can be eliminated. Of course, this would sacrifice, to some extent, the versatility of the circuitry to be directly used in different systems without the need for modification.

Reference is made to FIG. 5 which shows the user accessible adjustment. This adjustment provides enhanced double detect capability for the system by allowing the user to adjust the system for various conditions so that a broad range of documents and a broad range of printed matter and graphics on such documents can be properly handled by the system.

The adjustment for Channel 1 (Input 1) is through an adjustment knob 502 for potentiometer 416 and for Channel 2 (Input 2) an adjustment knob 504 for potentiometer 436. These potentiometer knobs are separately adjusted. For initial set up the service technician may make the original adjustment; however, it is contemplated that the machine operator or user will, on an on-going basis, make various adjustments based on the kinds of documents being processed as well as for the other factors previously noted.

Each of the channels has a separate bar graph array, bar graph array 480 for Channel I and bar graph array 476 for Channel 2. During user adjustment, each channel is separately adjusted to illuminate each bar graph array 476 and 480 as shown in FIG. 5A. With no document between the particular channel LED and its associated photo transistor, the potentiometer is adjusted until the entire bar graph is illuminated on the display as is shown at 506; with a single sheet of paper or other material between the particular channel LED and the photo transistor, the potentiometer is adjusted until the bar graph is illuminated to the "Single" line 508*a* on the bezel of the display as is shown at 508; with two documents between the channel's LED and photo transistor, the potentiometer is adjusted until the bar graph is illuminated to the "Double" line 510*b* on the bezel of the display as shown at 510. By using the operator accessible potentiometer knob adjustments with the bar graph array for each channel with a "Single" line and a "Double" line provided on the bezel on each display, simple operator adjustments are provided. This allows for easy, reliable and fast operator adjustment of the double detection system to handle various conditions which might occur. It allows for rapid job run changes involving different document types.

Figure 6:
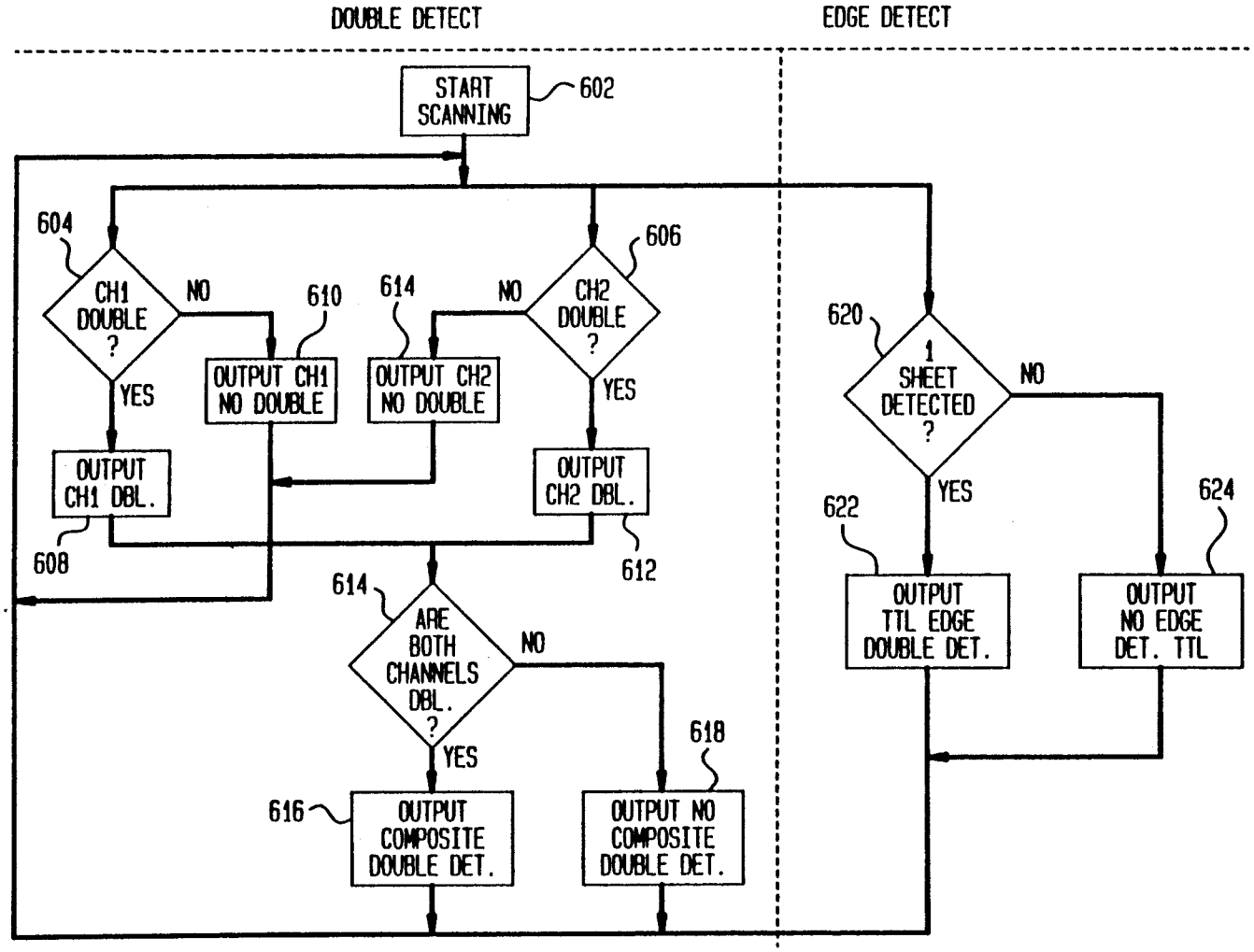
FIG. 6 is a flow chart of the general operation of the double detection system shown in FIG. 4 and 4A.

Reference is now made to FIG. 6 which is a flow chart of the general operation of the double detection system. At the start of scanning at 602, Channel 1 and Channel 2 are active to detect the presence of doubles, decision blocks 604 for Channel 1 and 606 for Channel 2. If a double is detected in Channel 1, an output is provided from Channel 1 indicating a double, at 608. If no double is detected from Channel 1, an output from Channel 1 is provided indicating no double at 610, and the system continues cycling.

If a double is detected from Channel 2, an output is provided at 612 indicating that a double is present. If Channel 2 indicates no double is present, an output is provided at 614 indicating no double is present. This similarly loops back to the start of scanning and the process continues. The output of a double from Channel 1 and Channel 2 at block 608 and at block 612 are used to determine whether both channels indicate a double is present, decision block 614. If both channels indicate a double is present, an output is provided that a composite double detection is present at 616. If both channels do not indicate a double is present, an output is provided that no composite double detection is present at 618. Similarly, at least a single sheet detection is determined from Channel 1, decision block 620. If at least a single sheet is detected, an edge detection is provided indicating a sheet is present at 622. If no sheet is detected, a no edge detection is provided indicating that no sheet is present at 624. The cycling of the system is a reiterative each time the start of scanning occurs.

Figure 7:
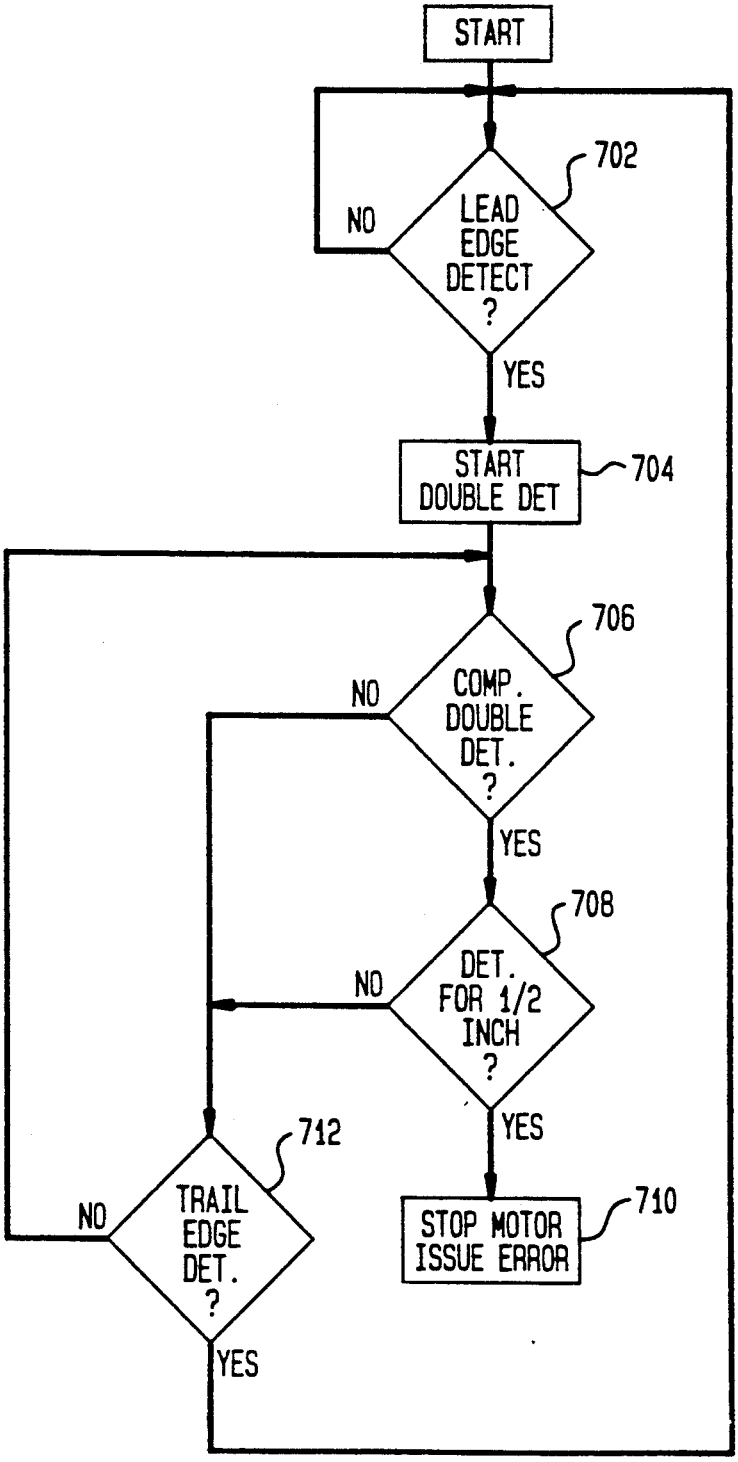
FIG. 7 is a flow chart of a double detect determination of the system shown in FIGS. 4 and 4A.

Reference is now made to FIG. 7 which is a flow chart of the double detect determination software. A determination is made whether the lead edge of a document is present, decision block 702. If a lead edge is not present, the system loops back to start. If a lead edge is present, however, the double detect process is started at 704. A decision block 706 determines whether a composite double detect condition is present, doubles in both Channel 1 and in Channel 2. A determination is thereafter made whether the composite double detect condition is present for a particular length of a sheet of paper or other material being fed, for example, ½ inch, decision block 708. If this condition exists, the system is stopped since a double condition is present, stop motor at 710.

If the composite double detection condition does not exist for the required length, for example for ½ inch, decision block 708, a determination is made, whether the trailing edge of the sheet of paper or other material has been detected, decision block 712. That is, a determination that the lead edge detection comparator 418 (FIG. 4) has transitioned first from a low to a high output, indicating the presence of a document leading edge and second from a high to a low output thereby indicating the presence of document trailing edge. If a document trailing edge is detected, the system loops back to the start of the routine; however, if a trailing edge is not detected the system loops back, to determine the status of the composite double detect signal, decision block 706.

This software arrangement allows the start of double detection anywhere on document and for any portion of the document, to verify that within that portion of the document or for the entire length of the document that doubles have or have not been detected.

In the present arrangement, as previously noted, the system samples for "doubles" being present composite signal for a distance of travel of ½ inch, for example, two or three inches down from the leading edge of a document. However, other sampling arrangements can beneficially be employed such as sampling only for the first one inch of the document or for the last one inch of the document if a document has bar patterns, dark print or colored areas in the middle of the document.

Again, because of different kinds of paper and different materials, as well as printing and graphic arrangements, or because of perforated forms and the like, the system may be unable to sample at the beginning of the document or at some other document portion or area without a false double detection or lack of a proper double detection. The present system enables these problems in sampling to be easily overcome by sampling in selected regions of the document. It should be recognized that, should it be desired, the ability to adjust at which point the double detection cycle starts can be made to be a user adjustment or a service technician adjustment, depending on the particular application. This could be accomplished by including a program to allow a user to enter data into the system, as by a keyboard or a touch screen, providing specific information as to the document type which would invoke a specific prestored doubles detection sampling (scan and averaging) for the document type. Alternatively, a separate entry of such information by the user can be provided to set the sampling for doubles.

The detection of the distance of the document moves under the LED - photo transistor sets for doubles detection can be done in many ways. For example, an encoder can be employed on the drive motor for the feeder. The encoder provides a clock signal to a software timer which is turned on and off by the output signal from the composite double detect. If the composite double detect signal is present, the timer is turned on and continues to be clocked by the motor encoder. If sufficient number of encoder clock pulses have occurred to indicate the desired length of travel of the sheet of paper or other material while the composite double detect signal is on, the timer is indicated to overflow. This provides an output signal which stops the feeder motor. On the other hand, if the timer does not overflow, the process continues. The timer is reset at the end of the detection of the trailing edge of the document or at any other suitable point as the sheet of paper or other material is being fed by the feeder 104.

While the invention has been disclosed and described with reference to the particular embodiment described in the preceding detailed description of the preferred embodiment, it will be clearly apparent, that variations and modifications may be made to the preferred embodiment. For example, additional third, fourth or further channels of information for generating the composite double detect signal may be included in the system. Or, as yet another example, both lateral, horizontal and vertical separation can be provided for the various LED photo transistor sets either separately or in combination. As yet another further example, the LED photo transistor structures can be mounted on different locations of the swing bridge arrangement of the feeding apparatus to provide different heights for the components so that they will be differently affected by ambient conditions within the equipment such as paper dust. Additionally, different forms of double detection can be employed other than LED and photo transistor sets mounted on opposite sides of a document feed path, and different forms of adjustment displays can be employed. As yet still a further example, the various Channel 1, Channel 2, composite double detect, inverted composite double detect, edge detect and inverted edge detect signals can be utilized in conjunction with different microcomputer arrangements and in different combinations to provide edge detection and doubles detection and composite doubles detection depending upon the available circuitry and or design constraints for the system. Thus, it is intended in the following claims to cover each variation and modification as falls within the true spirit and scope of the present invention.

What is claimed is:

1. A system for determining the proper operation of a feeding apparatus that is adapted to feed various different types of documents, comprising:

means for detecting the feeding of two or more overlapped documents;

adjusting means connected to said detecting means for adjusting said detecting means to detect the presence of overlapped documents for the various different type of documents to be fed by said feeding apparatus; and, display means connected to said detecting means for displaying a first condition when no documents are detected by said detecting means displaying a second condition when a single document is detected by said detecting means, and displaying a third condition when overlapped documents are detected by said detecting means.

2. A system for determining the proper operation of a feeding apparatus as defined in claim 1 wherein said adjustment means includes a coarse adjustment means and fine adjustment means for coarsely adjusting said detecting means to detect the presence of overlapped documents for various different types of documents to be fed by said feeding apparatus and for finely adjusting said detecting means to detect the presence of overlapped documents for the various different types of documents to be fed by said feeding apparatus.

3. A system as defined in claim 1 wherein said display includes a indication of a proper adjustment condition for a single document being detected by said detecting means and an indication of a proper adjustment condition for overlapped documents being detected by said detecting means.

4. A system for determining the proper operation of a feeding apparatus as defined in claim 3 wherein said display means is a bar graph array.

5. A system for determining the proper operation of a feeding apparatus as defined in claim 1 further comprising: a non user accessible indicator device for indicating the condition of said detecting means.

6. A system for determining the proper operation of a feeding apparatus as defined in claim 5 wherein said non user accessible indicator device is a light emitting diode.

7. A system for determining the proper operation of a feeding apparatus that includes a feed path adapted to feed various different types of documents, comprising:

first means for detecting the feeding of two or more overlapped documents;

second means for detecting the presence of two or more overlapping documents;

said first detecting means and said second detecting means physically located in the feed path of said feeding apparatus to detect the presence of overlapped documents in different locations in said feed path;

first adjusting means connected to said first detecting means for adjusting said first detecting means to detect the presence of overlapped documents for the various different types of documents fed by said feeding apparatus;

first display means connected to said first detecting means for displaying a first condition when no documents are detected by said first detecting means, displaying a second condition when a single document is detected by said first detecting means and displaying a third condition when overlapped documents are detected by said first detecting means;

second adjusting means connected to aid second detecting means for adjusting said second detecting means to detect the presence of overlapping documents for the various different types of documents to be utilized with said feed apparatus; and, second display means connected to said second detecting means for displaying a first condition when no documents are detected by said second detecting means, displaying a second condition when a single document is detected by said second detecting means and a displaying a third condition when overlapped documents are detected by said second detecting means.

8. A system for determining the proper operation of a feeding apparatus as defined in claim 7 wherein said first and second means for detecting the feeding of two or more overlapped documents each provide output signals and including means connected to said first and said second detecting means for providing a composite output signal indicating said first detecting means and said second detecting means each are simultaneously detecting predetermined conditions.

9. A system for determining the proper operation of a feeding apparatus as defined in claim 8 where said predetermined condition is that said first and said second detecting means are each detecting overlapped documents.

10. A system for determining the proper operation of a feeding apparatus that includes a feed path adapted to feed various different types of documents, comprising:

a light emitting diode photo transistor set for detecting the feeding of two or more overlapped documents, said light emitting diode mounted below the feed path of said feeding apparatus and said photo transistor mounted in registration with said light emitting diode above the feed path, of said feeding apparatus, said photo transistor including a first and a second electrode, the current flow through said first-second electrode current path being controlled by illumination from the said light emitting diode impinging upon said photo transistor;

said photo transistor first electrode connected to a source of operating potential;

variable resistor means connected between said photo transistor second electrode and ground; and, a display means connected to said photo transistor second electrode for displaying a first condition when no documents are detected by said light emitting diode photo transistor set, displaying a second condition when a single document is detected by said light emitting diode photo transistor set and displaying a third condition when overlapped documents are detected by said light emitting diode photo transistor set.

11. A system as defined in claim 10 further comprising a variable resistor connected between said display and said photo transistor second electrode.

12. A system as defined in claim 10 wherein said second electrode is an emitter electrode.

13. A system as defined in claim 10 wherein said display is a bar graph array having a bezel on said display, said bezel having markings thereon for the display of said second condition and said third condition.

14. A system for determining the proper operation of a feeding apparatus that includes a feed path adapted to feed various different types of documents, comprising:

a first light emitting diode photo transistor set for detecting the feeding of two or more overlapped documents, said first light emitting diode mounted below the feed path of said feeding apparatus and said first photo transistor mounted in registration with said light emitting diode above the feed path of said feeding apparatus, said first photo transistor including a first and second electrode, the current flow through said first and second electrode current path being controlled by illumination from said first light emitting diode impinging upon said photo transistor;

a second light emitting diode photo transistor set for detecting the feeding of two or more overlapped documents, said second light emitting diode photo transistor set physically separated from said first light emitting diode photo transistor set, said second light emitting diode mounted below the feed path of said feeding apparatus and said second photo transistor mounted in registration with said second light emitting diode above the feed path of said feeding apparatus, said second photo transistor including a first and second electrode, the current flow through said first and second electrode current path being controlled by illumination from said second light emitting diode impinging upon said second photo transistor;

said first photo transistor first electrode connected to a source of operating potential and said second photo transistor first electrode connected to a source of operating potential;

a first variable resistor means connected between said first photo transistor second electrode and grounds, and a second variable resistor means connected between said second photo transistor second electrode and grounds;

a first display means connected to said first photo transistor second electrode for displaying a first condition when no documents are detected by said first light emitting diode photo transistor set, displaying a second condition when a single document is detected by said first light emitting diode photo transistor set and displaying a third condition when overlapped documents are detected by said first light emitting diode photo transistor set; and, a second display means connected to said second photo transistor second electrode for displaying a first condition when no documents are detected by said second light emitting diode photo transistor set, displaying a second condition when a single document is detected by said second light emitting diode photo transistor set and displaying a third condition when overlapped documents are detected by said second light emitting diode photo transistor set.

* * * * *